US005803957A

United States Patent [19]

Murakami et al.

[11] Patent Number: 5,803,957

[45] Date of Patent: Sep. 8, 1998

[54] ELECTROLESS GOLD PLATING BATH

[75] Inventors: Tooru Murakami; Keizin Morimoto; Isamu Yanada; Masanobu Tsujimoto, all of Hirakata, Japan

[73] Assignee: C. Uyemura & Co.,Ltd., Osaka, Japan

[21] Appl. No.: 782,564

[22] Filed: Jan. 10, 1997

Related U.S. Application Data

[63] Continuation of Ser. No. 479,773, Jun. 7, 1995, abandoned, which is a continuation-in-part of Ser. No. 217,720, Mar. 25, 1994, abandoned.

[30] Foreign Application Priority Data

Mar. 26, 1993 [JP] Japan ..... 5-092202

[51] Int. Cl.[6] ..... B22F 7/00

[52] U.S. Cl. ..... 106/1.13; 106/1.18; 106/1.23; 106/1.26

[58] Field of Search ..... 106/1.13, 1.18, 106/1.23, 1.26

[56] References Cited

U.S. PATENT DOCUMENTS

| | | | |
|---|---|---|---|
| 3,300,328 | 1/1967 | Luce et al. | 117/47 |
| 3,468,676 | 9/1969 | Schneble | 106/1 |
| 3,589,916 | 6/1971 | McCormack | 106/1 |
| 3,993,808 | 11/1976 | Inaba | 427/377 |
| 4,009,297 | 2/1977 | Redmond et al. | 427/54 |
| 4,307,136 | 12/1981 | Prost-Tounier | 427/443.1 |
| 4,474,838 | 10/1984 | Halecky | 427/436 |
| 4,804,559 | 2/1989 | Ushio et al. | 427/96 |
| 4,838,937 | 6/1989 | Ott | 106/1.23 |
| 4,963,974 | 10/1990 | Ushio et al. | 357/80 |
| 4,978,559 | 12/1990 | Iacovangelo | 427/304 |
| 4,999,054 | 3/1991 | Perovetz | 106/1.23 |
| 5,079,040 | 1/1992 | Brandenburger | 427/305 |
| 5,198,273 | 3/1993 | Ando et al. | 427/437 |
| 5,202,151 | 4/1993 | Ushio et al. | 427/98 |
| 5,232,492 | 8/1993 | Krulik et al. | 106/1.23 |
| 5,258,062 | 11/1993 | Nakazawa | 406/1.23 |
| 5,318,621 | 6/1994 | Krulik | 106/1.23 |
| 5,320,667 | 6/1994 | Gesemann | 106/1.23 |
| 5,380,562 | 1/1995 | Hattori et al. | 427/437 |
| 5,635,253 | 6/1997 | Canaperi et al. | 427/437 |

FOREIGN PATENT DOCUMENTS

| | | | |
|---|---|---|---|
| 0272100 | 6/1988 | European Pat. Off. | C23C 18/44 |
| 0281804 | 9/1988 | European Pat. Off. | C23C 18/44 |

*Primary Examiner*—Benjamin Utech
*Attorney, Agent, or Firm*—Sughrue, Mion, Zinn, Macpeak & Seas, PLLC

[57] ABSTRACT

To an electroless gold plating bath comprising a water-soluble gold compound, a complexing agent, and a reducing agent is added a small amount of polyvinyl pyrrodidone. The bath allows a satisfactory gold plating film to be formed on metal portions on a non-conductive substrate without plating spread.

3 Claims, No Drawings

ELECTROLESS GOLD PLATING BATH

This is a continuation of application Ser. No. 08/479,773, filed Jun. 7, 1995, now abandoned, which is a continuation-in-part of application Ser. No. 08/217,720, filed Mar. 25, 1994, now abandoned.

BACKGROUND OF THE INVENTION

1. Field of the Invention

This invention relates to an electroless or chemical gold plating bath and more particularly, to an electroless gold plating bath comprising a water-soluble gold compound, a complexing agent, a reducing agent, and polyvinyl pyrrolidone for minimizing plating spread.

2. Prior Art

For utilizing the advantages of gold including its physical properties such as electric conduction and thermal bonding ability and its chemical properties such as oxidation resistance and chemical resistance, electroless gold plating has heretofore been applied to terminals and circuit surfaces of electronic industry parts including printed circuit boards, ceramic IC packages, ITO substrates, and IC cards.

Conventional electroless gold plating baths, however, tend to incur plating spread in that a coating also deposits at non-intended places, causing stains or blur, especially in the case of plating on metal portions formed on a non-conductive base such as a ceramic base. The plating spread is a serious problem particularly when it is desired to effect electroless gold plating on ceramic IC packages.

SUMMARY OF THE INVENTION

Therefore, an object of the present invention is to provide an electroless gold plating bath which when applied to a non-conductive base such as a ceramic base having metal portions thereon, can form a satisfactory gold coating only on the metal portions without incurring plating spread to the non-conductive base portion and is thus suited for gold plating of ceramic IC packages or the like.

Regarding an electroless or chemical plating bath comprising a water-soluble gold compound, a complexing agent, and a reducing agent, the inventors have found that by adding 0.1 to 100 mg/l of polyvinyl pyrrolidone to the bath, an aesthetically acceptable gold plating film free of stain or blur can be deposited on metal portions on a non-conductive base such as a ceramic base without incurring plating spread to non-intended places, i.e. non-conductive base portions not to be plated.

The present invention provides an electroless gold plating bath comprising a water-soluble gold compound in an amount of 1 to 20 grams/liter of gold ion, a complexing agent in an amount of 5 to 200 grams/liter, a reducing agent in an amount of 1 to 100 grams/liter and polyvinyl pyrrolidone in an amount of 0.1 to 100 mg/liter.

The present invention also provides a method of electroless gold plating a metal portion on a non-conductive base wherein the non-conductive base is immersed in the above-defined electroless gold plating bath whereby the gold coating is deposited only on the metal portion.

DETAILED DESCRIPTION OF THE INVENTION

A water-soluble gold compound is contained as a gold source in the electroless gold plating bath of the invention. It is any of gold compounds which can provide monovalent and trivalent gold ions in the plating bath. Useful examples include alkali metal and ammonium salts of gold sulfite such as sodium gold sulfite, potassium gold sulfite, and ammonium gold sulfite, and alkali metal salts of gold cyanide such as sodium gold cyanide, and potassium gold cyanide.

The water-soluble gold compound is blended so that the concentration is 1 to 20 grams/liter, preferably 2 to 8 grams/liter of gold ion. In general, the plating rate increases in substantial proportion to the amount of the water-soluble gold compound blended, that is, the concentration of gold ion in the plating bath. Concentrations in excess of 20 grams/liter are less desirable despite an increased plating rate because the plating bath would become less stable and the drag-out of the expensive gold compound is increased against economy. On the other hand, the plating rate is very low at gold ion concentrations below 1 grams/liter of gold ion.

The complexing agent may be any of well-known ones. Useful complexing agents are alkali metal and ammonium salts of sulfate such as sodium sulfite, potassium sulfite and ammonium sulfite, alkali metal salts of cyanide such as sodium cyanide and potassium cyanide, alkali metal and ammonium salts of thiosulfate such as sodium thiosulfate, potassium thiosulfate and ammonium thiosulfate, and EDTA. Other complexing agents including nitrilotriacetic acid (NTA), organic phosphonic acids and salts thereof, glucono-δ-lactone, and gluconates are also used.

Examples of the organic phosphonic acid include aminotri (methylenephosphonic acid) and salts thereof, 1-hydroxyethylidene-1,1-diphosphonic acid and salts thereof, ethylenediaminetetra(methylenephosphonic acid) and salts thereof, and diethylenetriaminepenta (methylenephosphonic acid) and salts thereof, with sodium, potassium and ammonium salts being the preferred salts.

The complexing agent is blended so that the concentration is 5 to 200 grams/liter, preferably 20 to 150 grams/liter. Less than 5 grams/liter of the complexing agent would be less effective whereas more than 200 grams/liter of the complexing agent would provide no further advantage and is thus uneconomical.

The reducing agent include hydrazines such as hydrazine hydrate, hydrazine sulfate, neutral hydrazine sulfate, hydrazine maleate, salts of the hydrazines, and hydrazine derivatives, for example, hydroxylamine, ascorbic acid and water soluble salts thereof (sodium, potassium and ammonium salts thereof), amineboranes such as trimethylamineborane (TMAB) and dimethylamineborane (DMAB), water soluble salts of borohydride such as sodium borohydride, and water-soluble salts of hypophosphorous acid.

The reducing agent is effective for causing gold ions in the plating bath to deposit on an article to be plated. The reducing agent is blended so that the concentration is 1 to 100 grams/liter, preferably 5 to 70 grams/liter. In general, the plating rate increases in substantial proportion to the concentration of the reducing agent. More than 100 grams/liter of the reducing agent would be less effective for accelerating the plating rate and rather render the plating bath less stable. Plating rate becomes very slow below 1 grams/liter of the reducing agent.

To a plating bath containing the above-mentioned water-soluble gold compound, complexing agent and reducing agent, polyvinyl pyrrolidone is added for restraining plating spread according to the present invention.

Polyvinyl pyrrolidone preferably has a weight average molecular weight of 1,000 to 360,000, preferably 10,000 to 100,000, and is commercially available from Kishida Reagents Chemical Co., Ltd. as polyvinyl pyrrolidone K-12, K-15, K-30, K-60, K-90, etc.

Polyvinyl pyrrolidone is added in an amount of 0.1 to 100 mg/liter, preferably 0.1 to 50 mg/liter, more preferably 0.3 to 30 mg/liter. Below the range, polyvinyl pyrrolidone would not be effective for restraining plating spread. Too much amounts of polyvinyl pyrrolidone would slow down the plating rate.

Several advantages are obtained from the addition of polyvinyl pyrrolidone. Even when an article to be plated is a metal portion formed on a non-conductive substrate such as a ceramic substrate, polyvinyl pyrrolidone ensures that a satisfactory gold coating is deposited only on the metal portion without incurring plating spread. Polyvinyl pyrrolidone is also effective for preventing decomposition of the plating solution. Although the mechanism of polyvinyl pyrrolidone achieving such advantages is not well understood, we have the following hypotheses.

One probable presumption is that polyvinyl pyrrolidone is adsorbed to a gold plating film or gold colloid particles resulting from solution decomposition, thereby preventing gold deposition on the non-metal portion. A certain mechanism allows plating to proceed on the plating film, but not on the gold colloid particles, thereby preventing solution decomposition and plating spread. An alternative presumption is that polyvinyl pyrrolidone is adsorbed to a non-conductive portion such as a ceramic portion of an article to prevent gold deposition thereon. That is, polyvinyl pyrrolidone is selectively adsorbed to the non-conductive portion rather than to the gold plating film to prevent plating spread. A further presumption is that since gold colloid particles have a remarkably larger surface area per unit volume than the plating surface, polyvinyl pyrrolidone prevents plating spreads by selectively preventing growth of gold colloid to restrain decomposition of the plating solution and by preventing gold colloid particles resulting from solution decomposition from being adsorbed to the non-conductive portion to form nuclei from which plating grows.

In addition to the water-soluble gold compound, complexing agent, reducing agent, and polyvinyl pyrrolidone, the electroless gold plating bath of the invention may further contain a nitrogenous compound which is effective for increasing the plating rate.

Examples of the nitrogenous compound used include ammonia, aminocarboxylic acids, iminocarboxylic acids, other water-soluble nitrogen-containing organic compounds and salts thereof. Examples of the ammonia and salts thereof include aqueous ammonia, ammonium sulfate, ammonium chloride, ammonium acetate, and ammonium nitrate. Examples of the aminocarboxylic acid include essential amino acids and examples of the iminocarboxylic acid are ethylenediaminetetraacetic acid and nitrilotriacetic acid. Examples of the other water-soluble nitrogen-containing organic compound include aliphatic amines such as ethylenediamine, diethylenetriamine, triethylenetetramine, tetraethylenepentamine, hexamethylenetetramine, and guanidine; aminoalcohols such as monoethanolamine, diethanolamine, and triethanolamine; aromatic amines such as p-methylaminophenol, aminophenol, phenylenediamine, and aminobenzoic acid; heterocyclic compounds containing a nitrogen atom such as imidazole, uracil, morpholine, and pyrazine; nitrogenous sulfonic acids such as bis (hydroxyethyl)aminoethanesulfonic acid, metanilic acid, anthranilic acid, pyridine-sulfonic acid, 8-hydroxyquinoline-5-sulfonic acid, and taurine; and pyridines such as dipyridyl, picolinic acid, and dihydroxypyridine. Preferred water-soluble nitrogenous organic compounds are aromatic amines such as p-methylaminophenol and aminophenol though not limited thereto. The amount of the nitrogenous compound added is suitably selected depending on its type or the like and not critical. For ammonia and analogs, the preferred amount is 1 to 200 grams/liter, especially 5 to 150 grams/liter. For the aminocarboxylic acids, imino-carboxylic acids and other water-soluble nitrogen-containing organic compounds, the preferred amount is 0.01 to 100 grams/liter, especially 0.05 to 50 grams/liter.

A water-soluble lead compound such as lead acetate, lead nitrate and lead methanesulfonate and/or a water-soluble thallium compound such as thallium sulfate may be added to the plating bath of the present invention to incorporate a lead ion and/or thallium ion therein for increasing the plating rate and improving the crystalline state of a deposit coating. The amount of the water-soluble lead compound and/or thallium compound added is preferably 0.1 to 50 mg/liter, especially 0.5 to 30 mg/liter calculated as metal ion. Less than 0.1 mg/liter of the lead or thallium ion would not be effective whereas more than 50 mg/liter would provide only a slight increase of its effect and sometimes result in a plating film of uneven appearance.

When it is desired to plate gold on a copper substrate using the plating bath of the invention, a copper ion can be leached into the bath and gold deposition can take place where copper ion leaching has took pace. To prevent the copper leaching, the plating bath may further contain benzotriazole and/or cyanide ion ($CN^-$) where the plating bath is free of cyanide ion. Benzotriazole is adsorbed on copper or form a water-insoluble chelate with a copper ion for preventing dissolution of a copper ion. Although the interaction mechanism of cyanide ion is not well understood, it is presumed that $Cu^+$and $CN^-$form a complex to decrease the reducing power of $Cu^+$.

Although the amount of benzotriazole added is not critical, it is preferably 0.001 to 10 grams/liter, especially 0.01 to 1 gram/liter. Less than 0.001 gram/liter of benzotriazole would not be effective whereas more than 10 gram/liter would provide only a slight increase of its effect and sometimes lower the plating rate. A cyanide ion is added where the water-soluble gold compound and complexing agent used are compounds other than cyanides, for example, such as gold sulfite and sodium sulfite. Although the amount of cyanide added is not critical, it is preferably about 0.01 to 2 grams/liter, especially 0.05 to 1 gram/liter. Less than 0.01 gram/liter of cyanide would not be effective whereas more than 2 grams/liter would cause a substantial lowering of plating rate. The cyanide source for supplying a cyanide ion to the plating bath includes NaCN, KCN, $Na[Au(CN)_2]$ and $K[Au(CN)_2]$.

When plating is carried out using the electroless gold plating bath of the invention, an article to be plated such as a printed circuit board and ceramic IC package is immersed in the bath. The printed circuit board and ceramic IC package are preferably those having an electroless plating Ni/B film and/or an electroless plating Ni/P film formed thereon and a gold replacement plating film formed further thereon although the invention is not limited thereto.

Next the plating conditions are described. The plating bath may have a pH of 3 to 14, especially 4 to 14 depending on a type of reducing agent or the like. The preferred pH range varies with a particular type of reducing agent. For example, nearly neutral pH levels (pH 6 to 9) are preferred for ascorbic acid, and hypophosphites, strongly alkaline pH levels (pH 10 to 14) are preferred for borohydrides, and neutral to alkaline pH levels (pH 6 to 14) are preferred for hydrazines and amineboranes.

The plating temperature or bath temperature is preferably about 40° to 90° C., especially about 50° to 80° C. The plating rate would be too low at temperatures lower than 40° C. At temperature above 90° C., plating stability would be lost despite an increased plating rate. The plating solution may be agitated. A mechanism of striking an article to be plated by a hammer is preferably set to prevent generation of gas pits. The solution may be filtered batchwise or by circulation. Preferably the plating solution is pumped and circulated through a filter for eliminating a temperature variation of the solution and removing solid debris from the solution. Vigorous agitation of the plating solution can retard plating, resulting in a low plating rate. Therefore, agitation of the plating solution, circulation of the plating solution for filtering and rocking of an article to be plated should preferably be moderate.

It is also possible to introduce air into the plating bath because air introduction is effective for preventing generation of gold colloid particles or gold particles in the bath. Although the effect of air introduction is not well understood, it is presumed that Au can be effectively dissolved by $SO_3^{2-}$ in the presence of $O_2$ through a mechanism similar to the well-known reaction:

$$CN^- + O_2 + Au \rightarrow Au^+$$

where a gold sulfite salt and a sulfite are used. Where copper is the underlying metal, it is presumed that although copper can be leached into the plating solution to generate gold particles through the reaction:

$$Au^+ + Cu^+ \rightarrow Au\downarrow + Cu^{2+},$$

$Cu^+$ generated as a result of leaching is oxidized by $O_2$ into non-harmful $Cu^{2+}$. Although it is unknown whether or not the above-mentioned reaction $Au^+ + Cu^+ \rightarrow Au\downarrow + Cu^{2+}$ proceeds, it was empirically found that Au deposited where Cu leaching occurred.

Air can be introduced into the plating bath by blowing air therein. Then the procedure of agitating the plating bath may be air agitation whereby air is introduced at the same time as agitation. Alternatively air may be blown into the bath separately from agitation. Preferably air is blown into the plating bath so as to avoid direct contact with the surface being plated. To this end, an air partition may be disposed in the plating bath. If air directly contacts the surface being plated, solution flow at the plating interface becomes faster and uneven, resulting in inconveniences such as uneven color and uneven thickness of a plating film and a lowering of plating rate.

A plating rate of about 0.1 to about 5 μm/hr. is generally available with the electroless gold plating bath of the invention. Self catalysis is expected when a plating film is formed on a gold plate (gold plating film). By replenishing the gold source and reducing agent for their consumption, the bath can be used about 5 turns (5×M grams/liter wherein M is a gold ion concentration at the initial bath).

EXAMPLE

Examples of the present invention are given below by way of illustration and not by way of limitation.

Example 1

The article to be plated was an IC package which was prepared from an alumina substrate having a metallized pattern thereon by forming an electroless plating Ni—B film of 1 μm thick on the metallized pattern, forming an electroless plating Ni—P film of 2 μm thick thereon, and forming a replacement plating gold film of 0.1 μm thick thereon. The IC package was immersed in a plating bath of the following composition wherein electroless gold plating was carried out under the following conditions. The plating rate was 3 μm/hr.

| Plating bath composition | |
|---|---|
| Sodium gold sulfite | 4 g/l as monovalent gold ion |
| Sodium sulfite | 70 g/l |
| EDTA-2Na | 45 g/l |
| Hydrazine hydrate | 12 g/l |
| Polyvinyl pyrrolidone K-30 | 0.5 mg/l |
| pH | 10 |
| **Plating conditions** | |
| Temperature | 70° C. |
| Solution volume | 500 ml |
| Agitation | stirrer agitation |
| Time | 40 min. |

At the end of plating, the IC package was inspected to find no plating spread. It was fully susceptible to gold wire bonding and die bonding.

Example 2

An IC package was subjected to electroless gold plating by the same procedure as in Example 1 except that 0.8 g/l of sodium thiosulfate and 2 g/l of ethylenediamine were added to the plating bath of Example 1. The plating rate was 3.5 μm/hr.

At the end of plating, the IC package was inspected to find no plating spread. It was fully susceptible to gold wire bonding and die bonding.

Example 3

The same IC package as used in Example 1 was immersed in a plating bath of the following composition wherein electroless gold plating was carried out under the following conditions. The plating rate was 2 μm/hr.

| Plating bath composition | |
|---|---|
| Potassium gold cyanide | 4 g/l as monovalent gold ion |
| Potassium cyanide | 4 g/l |
| KOH | 10 g/l |
| Triethanolamine | 10 g/l |
| Dimethylamineborane | 2 g/l |
| Polyvinyl pyrrolidone (K-15) | 1 mg/l |
| Lead acetate | 2 mg/l as lead ion |
| **Plating conditions** | |
| Temperature | 60° C. |
| Solution volume | 500 ml |
| Agitation | cathode rocking, 1 m/min. |
| Time | 60 min. |

At the end of plating, the IC package was inspected to find no plating spread. It was fully susceptible to gold wire bonding and die bonding.

Example 4

The article to be plated was a printed circuit board which was prepared from an epoxy resin/glass fiber substrate having a copper pattern thereon by forming an electroless nickel plating film of 5 μm thick on the copper pattern, and forming an immersion gold film of 0.04 μm thick thereon. The printed circuit board was immersed in a plating bath of the following composition wherein electroless gold plating was carried out under the following conditions. The plating rate was 1 μm/hr.

| Plating bath composition | |
|---|---|
| Sodium gold sulfite | 4 g/l as monovalent gold ion |
| Sodium sulfite | 120 g/l |
| Sodium thiosulfate | 2 g/l |
| EDTA-2Na | 40 g/l |
| Sodium ascorbate | 20 g/l |
| Polyvinyl pyrrolidone K-30 | 20 mg/l |
| 1,2,3-benzotriazole | 100 mg/l |
| pH | 7,5 |
| Plating conditions | |
| Temperature | 70° C. |
| Solution volume | 500 ml |
| Agitation | cathode rocking, 0.2 m/min. |
| Time | 60 min. |

At the end of plating, the printed circuit board was inspected to find no plating spread. It was fully susceptible to gold wire bonding and die bonding.

Comparative Example 1

Using the same plating bath as in Example 1 except that polyvinyl pyrrolidone was omitted, an IC package was subjected to electroless gold plating by the same procedure as in Example 1. At the end of plating, the IC package was inspected to find plating spread, that is, the plating film extended to the alumina substrate beyond the requisite area (the metallized pattern).

Comparative Example 2

Using the same plating bath as in Example 3 except that polyvinyl pyrrolidone was omitted, an IC package was subjected to electroless gold plating by the same procedure as in Example 3. At the end of plating, the IC package was inspected to find plating spread, that is, the plating film extended beyond the requisite area.

There has been described an electroless gold plating bath which contains a specific stabilizer for ensuring that a satisfactory gold plating film is formed on metal portions on a ceramic substrate as in ceramic IC package without plating spread.

Although some preferred embodiments have been described, many modifications and variations may be made thereto in the light of the above teachings. It is therefore to be understood that within the scope of the appended claims, the invention may be practiced otherwise than as specifically described.

We claim:

1. An electroless gold plating bath comprising a water-soluble gold plating bath comprising a water-soluble salt of a gold sulfite in an amount of 1 to 20 grams/liter of gold ion, a complexing agent selected from the group consisting of alkali metal and ammonium salts of sulfite, and EDTA in an amount of 5 to 200 grams/liter, a reducing agent selected from the group consisting of ascorbic acid and water-soluble salts thereof in an amount of 1 to 100 grams/liter, and polyvinyl pyrrolidone in an amount of 0.1 to 100 mg/liter, said electroless gold plating bath having a pH of 6 to 9.

2. A bath according to claim 1 which further contains a lead ion, a thallium ion or a mixture thereof.

3. A bath according to claim 1 wherein said polyvinyl pyrrolidone is present in an amount of 0.3 to 30 mg/liter.

* * * * *